United States Patent [19]

Seragnoli

[11] 4,196,560

[45] Apr. 8, 1980

[54] DISPENSING APPARATUS FOR MACHINES FOR PACKETING CIGARETTES INTO HINGED-LID RIGID TYPE CIGARETTE PACKETS

[75] Inventor: Enzo Seragnoli, Bologna, Italy

[73] Assignee: G. D. Societa per Azioni, Bologna, Italy

[21] Appl. No.: 90

[22] Filed: Jan. 2, 1979

[30] Foreign Application Priority Data

Jan. 9, 1978 [IT] Italy ..... 3305 A/78

[51] Int. Cl.[2] ..... B65B 57/00; B65B 51/14

[52] U.S. Cl. ..... 53/53; 53/77; 53/388

[58] Field of Search ..... 53/53, 77, 388

[56] References Cited

U.S. PATENT DOCUMENTS

| | | | |
|---|---|---|---|
| 3,590,556 | 7/1971 | Focke | 53/53 |
| 4,020,608 | 5/1977 | Seragnoli | 53/388 X |

*Primary Examiner*—Travis S. McGehee

*Attorney, Agent, or Firm*—Fitzpatrick, Cella, Harper & Scinto

[57] ABSTRACT

A dispensing apparatus for machines for packeting cigarettes into hinged-lid rigid type cigarette packets is of the type comprising an intermittently rotating wheel having radially disposed compartments for housing individual cigarette packets. A dispensing channel is associated with the wheel and upper and lower heated plates cooperating with the compartments. A pushing member is provided at the end of the dispensing channel to push, during the normal operation of the apparatus, the individual packets into a first track coplanar to the dispensing channel. A control mechanism, should the wheel accidentally stop, acts on a pair of mechanical systems which cause the spacing apart of the plates from the compartments and further starts a timer. Should the stoppage of the wheel last longer than a preselected time, the timer actuates locking means which lock the pushing member to discard, along a second track disposed in line with the dispensing channel at the restoration of the normal operation of the apparatus, a number of packets corresponding to the total number of packets contained in the apparatus.

7 Claims, 5 Drawing Figures

DISPENSING APPARATUS FOR MACHINES FOR PACKETING CIGARETTES INTO HINGED-LID RIGID TYPE CIGARETTE PACKETS

BACKGROUND OF THE INVENTION

The present invention relates to dispensing apparatus for use in machines for packeting cigarettes and particularly for packeting cigarettes into hinged-lid rigid type cigarette packets.

In known machines of this kind bundles of cigarettes are enclosed in an inner envelope of tin-foil and the envelope is then inserted into an outer, parallel sided cardboard packet.

The hinged-lid rigid type cigarette packet is obtained by a series of folding operations carried out on a substantially rectangular piece of cardboard suitably glued along the areas thereof which come into contact and are stuck together by means of conventional glueing apparatuses of the type, for example, disclosed in our Italian Pat. No. 997,144.

During the transferring steps which follow the glueing operation, particular attention has to be given to ensure that, owing to the elasticity of the material and to the mechanical stresses to which the packets are subjected, the glued portions thereof do not move apart or become displaced. These drawbacks mainly appear on those portions of the packet which are, in the final stages, subjected to the folding operations, and in particular along the side faces of the packet.

It is therefore advisable, for the abovementioned reasons, to subject the individual cigarette packets during transfer thereof to a gauging operation, i.e. each packet has to be inserted into a space which is exactly complementary to the shape of the packet, and to retain the packet in the space for a time long enough to assure proper drying of the glued portions.

By applying heat to the packet the drying time can be shortened. Accordingly, various conventional dispensing apparatuses are provided with a suitably heated channel along which packets are moved and along which each individual packet is kept in its correct position, not only by the walls of said channel, but also by the pressure exerted thereon by the contiguous packets.

A safer operation, however, is provided by those dispensing apparatuses to which further reference will be made hereinafter, of the type in which each packet is advanced intermittently while contained by a rigid compartment and those sides of the compartment adjacent to the sides of the packet are defined by electrically heated plates, which plates are stationary or moved against the packets during each dwell of the intermittent motion.

Due to use of electrically operated means, various problems arise when the motor of the packeting machine and the related dispensing apparatus stop. In this situation, the packets contained in the dispensing apparatus are subjected to a heating action which is excessive relative to that strictly necessary to assure the correct drying. This, obviously, damages the packets as well as their contents. As the electrically heated plates do not cool immediately, simply switching off the electric current is practically useless in avoiding damage to the packets and/or to the cigarettes.

SUMMARY OF THE INVENTION

One object of the present invention is, therefore, to provide a dispensing apparatus of the kind hereinbefore defined which performs reliably in gauging and drying the packets, and avoids, as far as possible, damage caused by the heating means should the apparatus stop accidentally for a certain time, and to discard the damaged packets should said time last too long.

According to this invention, a dispensing apparatus for machines for packeting cigarettes for hinged-lid rigid type cigarette packets comprises: a wheel carried by a vertically disposed shaft and provided with radially disposed compartments each for housing one cigarette packet longitudinally disposed relative to the radius of said wheel and edgewise relative to the plane of the wheel; a dispensing channel coplanar and radially disposed relative to said wheel; first driving means connected to main motor means of said machine for intermittently rotating said wheel; packet feeding means positioned upstream relative to the rotational direction of said wheel for feeding individual packets into said compartments; pushing means for ejecting the packets from said compartments and for feeding the same into and along said dispensing channel; an upper and a lower heated plate delimiting the upper and the lower sides of said compartments; second driving means for reciprocatingly driving supporting means of said upper plate and for subjecting said plate during each dwell of said wheel to a displacing movement from a first position relatively spaced from said compartments to a second position in contact with the compartments; and stationary supporting means for said lower plate, wherein said apparatus further comprises a first and a second track at the end of said dispensing channel; switching means mounted adjacent the end of said dispensing channel for conveying individual packets onto said first track during a normal operating condition of the apparatus; third driving means associated with said main motor means for driving said switching means; first control means sensitive to the stopping of said main motor means; timer means associated with said first control means for measuring the stopping time of said main motor means during an abnormal operating condition of the apparatus; fourth driving means controlled by said first control means for driving said supporting means of the lower and upper plates for moving said plates to a position relatively spaced from the compartments during a first stage of said abnormal operating condition; second control means controlled by said timer means when the latter measures a duration of the stopping time during a second stage of said abnormal operating condition which is longer than a preselected time; locking means controlled by said second control means for locking said switching means for conveying individual packets onto said second track; and counting means associated with said main motor means and with said locking means for disengaging said locking means following restoration of said normal operating condition of the apparatus after counting a number of machine cycles equal to the number of packets contained in said dispensing apparatus.

A preferred exemplary embodiment of dispensing apparatus according to this invention will now be described in detail with reference to the accompanying drawings in which:

DESCRIPTION OF THE PREFERRED EMBODIMENT

Figure 1:
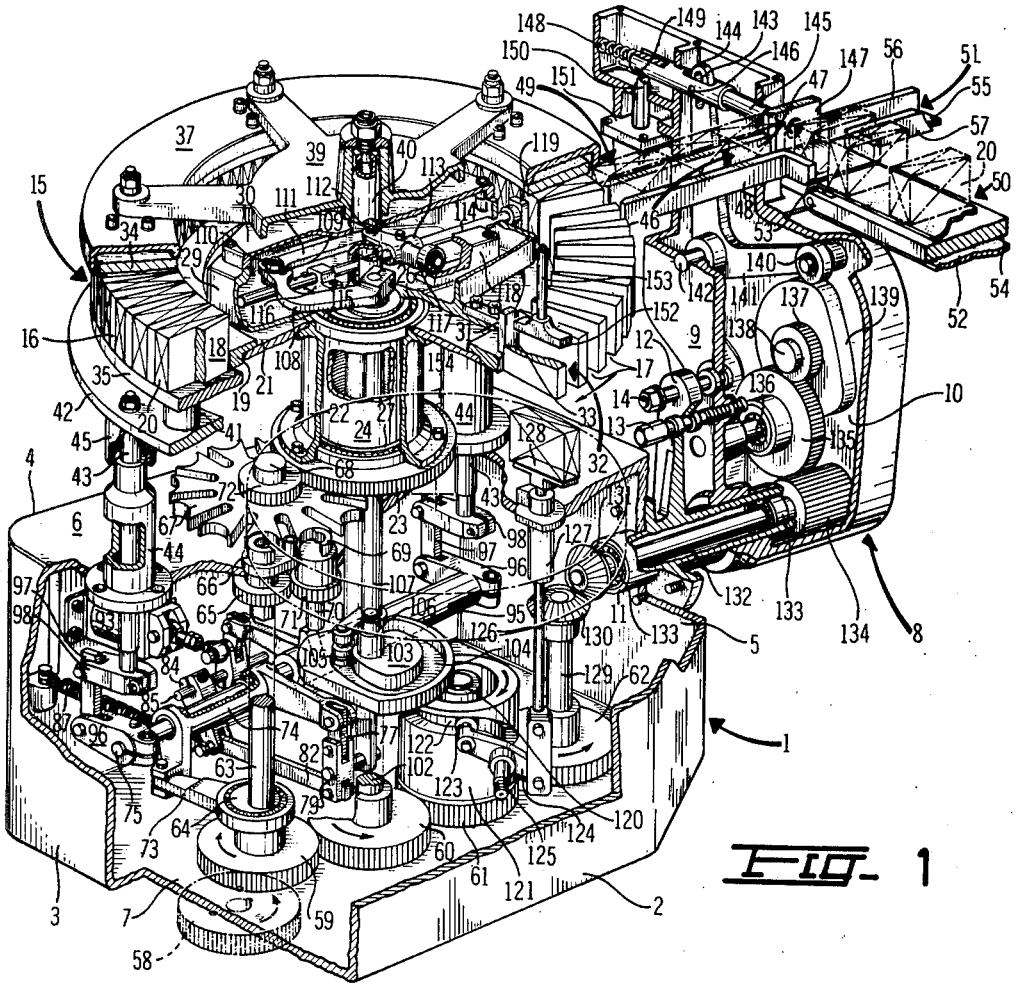
FIG. 1 is a perspective view of a dispensing apparatus with some parts sectioned or omitted for a better viewing of other parts of the apparatus.

With particular reference to FIG. 1, 1 indicates a first box-like housing forming part of the base of a conventional machine for packeting cigarettes into hinged-lid rigid type cigarette packets.

The housing 1 contains some of the mechanical components of the dispensing apparatus according to the present invention and comprises vertical side walls 2, 3, 4 and 5, the walls 4 and 5 being respectively parallel to walls 2 and 3, and top and bottom horizontal walls 6 and 7. A second box-like housing 8 is secured to the housing 1. The second housing 8 comprises two vertical side walls 9 and 10 extending parallel to the walls 4 and 5. The second housing 8 contains further mechanical elements of the apparatus.

The second housing 8 is secured to the first housing 1 by means of a tubular sleeve 11 normally disposed relative to wall 5 and having a flange adjacent to the outer surface of the wall 5. The sleeve 11 has one end extending inside the housing 1 and the other extending inside the housing 8.

The position of the second housing 8 relative to housing 1 can be suitably adjusted by sliding the second housing 8 along tubular sleeve 11 and the latter is therefore provided with a vertically extending portion 12 which is connected to wall 9 by an adjusting screw 13 and by a locking pin 14.

Mounted in a horizontal plane above the housing 1 there is a wheel, generally indicated by the arrow 15, having a vertical axis of rotation and comprising an annular crown member 16 which is subdivided into thirty-seven equispaced compartments 17, each compartment being delimited on two sides by spaced, substantially vertical walls 18 extending radially relative to the crown member and having open upper, front and lower sides. The crown member 16 comprises upper and lower portions and the lower portion has an integral annular ring 19 facing the axis of rotation which provides a cylindrical abutment. The compartments 17, as it will be disclosed hereinafter, are each adapted to receive, with precision fitting, a cigarette packet 20 disposed longitudinally and edgewise relative, respectively, to the radius of the wheel 15 and to the plane of the wheel.

The ring 19 is also integral with a disc 21 which is secured to the upper end of a hub 22, the lower end of which hub is secured to a crown gear 23. The gear 23 drives the wheel 15 intermittently, as will be described hereinafter.

The wheel 15 is rotatably carried by a cylindrical element 24 coaxially disposed relative to the wheel 15 and supported within an opening 25 (see also FIGS. 2 and 3) provided in the wall 6 of housing 1. The lower end of the hub 22 is rotatably supported by an annular thrust face 28 provided on the lower end of the cylindrical element 24 and upper and lower ball bearings 26 and 27 are interposed between the hub 22 and the element 24.

Resting on the upper end of the cylindrical element 24, inside the crown member 16, there is provided a box-like casing 29 having a horizontal cover 30 and housing mechanical components disclosed hereinafter.

A rectangular guide member 31 is fixed to the outer surface of the casing 29 and is provided with a guiding wall 33 superimposed on the annular ring 19 and lying in a plane which is tangential to the outer surface of the ring 19. The fixed guide member 31 is aligned with a position or station indicated by the arrow 32 which is the point of inlet for the entry of cigarette packets 20 into the compartments 17 in the crown member 16. This position will hereinafter be referred to as the "inlet position".

Above and below relative to the crown member 16, the compartments 17 are delimited respectively by plates 34 and 35, both having an annular shape and provided with an opening in line with the inlet position 32. The plates 34 and 35 are heated by electrical resistances, not shown in the drawings.

The plate 34, other than acting as a heating member, also has the function of a pressing or tamping member, as will be described hereinafter, and is supported along its full extent by a carrier 37 and by means of spacers 36.

The carrier 37 is, in its turn, supported by a spider 39 through coiled springs 38. The spider 39 is mounted on the upper end of a hollow shaft 40 and coaxial therewith. For reasons which will become clear as the description proceeds, the connection between the spider 39 and the hollow shaft 40 is made through conventional registering means which allows, through a simple manual operation, the axial position of the spider 39 relative to its supporting means to be changed.

The lower portion of the hollow shaft 40 is contained within the housing 1 wherein it is connected to mechanical stepping means hereinafter to be described. The shaft 40 extends freely through the wall 6, the cylindrical element 24 and the casing 29 and its upper end protrudes above the crown member 16.

The plate 35 serves both as a heating member and as a counteracting member for the pressure from plate 34, as it will be described hereinafter, and is supported by an annular ring 42 through cylindrical spacing members 41. The ring 42, in its turn, is supported in two diametrically disposed positions by vertical shafts 43 which are free to slide axially in fixed tubular guide sleeves 44 secured above the wall 6 of the housing 1.

The lower ends of the shafts 43 are connected, inside the housing 1, to driving means hereinafter to be described.

The reference numeral 45 indicates cylindrical protective covers which are secured to the under face of the ring 42 and coaxially disposed relative to the shafts 43.

Above the box-like housing 8, and supported thereby in a manner not shown in FIG. 1, there is provided a dispensing channel, indicated by the arrow 46, which is coplanar with the crown member 16 and radially disposed relative thereto.

The sides of the channel 46 are defined by two relatively spaced vertical walls 47 and 48 which extend a distance which is substantially equal to or a multiple of the longitudinal dimension of a cigarette packet 20 and the width of said channel 46 is substantially equal to the width of the compartments 17. The inlet of channel 46 is positioned adjacent to the crown member 16 in line with a position or station indicated by the arrow 49, hereinafter referred to as the "outlet position". The outlet position 49 is angularly displaced 270° from the inlet position 32 considered in the direction of rotation of the wheel 15.

The outlet end of the channel 46 leads into two transfer tracks 50 and 51 coplanar with the channel 46, the first track 50 being normally disposed relative to the channel 46 and the second track 51 being in line with the channel 46.

The first track 50 comprises a conveyor belt 52 which in operation is continuously moved by conventional means, not shown. The belt 52 extends over rollers 53 (only one roller is shown in FIG. 1) and is supported by a horizontal plate 54. The second track 51, hereinafter called the "rejecting track", comprises a horizontal stationary plate 55 having vertical side walls 56 and 57 aligned respectively with walls 47 and 48 of the dispensing channel.

The drive for the whole unit is provided by a gear wheel 58 keyed onto a vertical shaft (not shown) and rotated counterclockwise by the main motor of the packeting machine through conventional drive means, not shown.

The gear wheel 58 rotates a second gear wheel 59 meshing with a third gear wheel 60 which rotates, through a fourth gear wheel 61, a final gear wheel 62.

Gear wheels 59, 60, 61 and 62 are all located inside the housing 1 in a common horizontal plane.

The gear wheel 59 which, in use, rotates in a clockwise direction is keyed onto a vertical shaft 63 which is rotatably supported, in a manner not shown in FIG. 1, by the walls 6 and 7 of the housing 1. The upper end of the shaft 63 protrudes outside the housing.

The following components are also keyed onto the shaft 63. As considered from the lower end of the shaft 63 upwards, there is mounted an eccentric bearing 64 located immediately above the gear wheel 59. Spaced from the bearing 64 adjacent to the upper wall 6 of the housing 1 there is mounted a further gear wheel 65 of smaller diameter than the gear wheel 59, and above the gear wheel 65 on the outside of the housing 1, there is a conventional stepping device 66 comprising an idler roller, arcuate centering member and Geneva wheel 67. The Geneva wheel has twelve vanes and is keyed to a vertically extending shaft 68 mounted outside the housing 1. The Geneva wheel 67 is adapted to be intermittently rotated by the stepping device.

The stepping device 66 operates a second arcuate centering member 69 the purpose of which is to act as a stabilizer for the Geneva wheel 67 as described in Italian Pat. No. 845,131.

The second centering device 69 is mounted on a vertical shaft 70, on which shaft is keyed, beneath the wall 6, a gear 71 meshing with the gear wheel 65.

Keyed onto the shaft 68, immediately above the Geneva wheel 67, there is mounted a gear 72 arranged to drive the crown gear 23 intermittently with a ratio 1:3. Due to the mechanical action of the stepping device 66 and to the ratio of the gears 72, 23 as described above, the wheel 15 is rotated, during operation of the packeting machine, with a clockwise 10° intermittent motion.

The eccentric bearing 64, keyed to the shaft 63, is connected through a horizontally extending connecting rod 73 to a horizontally extending yoke on one arm of a two armed lever 74. The lever 74 is pivotally mounted on the left end (as viewed in FIG. 1) of a horizontal shaft 75 extending substantially parallel to walls 2 and 4 of housing 1.

A second arm of the lever 74, which extends substantially parallel to the first arm, is connected at its free end by means of a pin 76, extending parallel to the shaft 75, to a small link rod 77, which link rod 77 is, in its turn, connected by its other end, through a pin 78, to the upper end of a rocking lever 79 pivotally mounted on a pivot pin 80 extending parallel to the shaft 75 and having a laterally extending end portion connected to the lower end of the hollow shaft 40.

Due to the arrangement of the connections described above, the hollow shaft 40 is subjected, during rotation of the gear wheel 59, to an axially directed reciprocating motion.

The lower end of the rocking lever 79 is connected, through a pin 81 extending parallel to the pin 80, to one end of a substantially horizontally extending rod 82 which rod 82 is pivotally connected at its other end to a pin 83 which also extends parallel to the pin 80.

The pin 83 connects the rod 82 to the lower end of a short lever 84 the other end of which lever is rigidly connected to a small shaft 85, extending parallel to the shaft 75 and rotatably supported by a web 86 of the housing 1. A spring 87 is hooked to the pin 83 and the other end of the spring is connected to the wall 4 of the casing 1. There is also a second lever 88 extending substantially vertically within the casing 1 the lower end of which is rigidly connected to the shaft 85 and the upper end of which is connected, through a pin 89 extending parallel to the shaft 85, to a link member 90.

The pin 89 is also connected, through an articulated joint 91, to a rod 92 secured to the keeper of an ejection type electromagnet 93 supported by the wall 4 of the housing 1.

The upper end of the link rod 90 is connected to an arm 94 extending substantially parallel to the wall 6 and integral with a tubular sleeve 95 (FIG. 1) carried by the shaft 75 and integral with the latter.

To each free end of the shaft 75 there is keyed one of a pair of arms 96 and each arm 96 is connected, through a link rod 97 and a horizontally extending lever 98, to the lower end of one of the two vertically extending shafts 43.

Above the tubular sleeve 95 and in line with the arm 94 there is provided a tooth 99 (FIGS. 2 and 3 only) adapted to be engaged by a stop 100 provided on a web 101 protruding from the wall 6 of the housing 1.

The gear wheel 60 is keyed to the lower end of a vertical shaft 102 fully accommodated inside the housing 1.

A disc cam 103 is secured to the lower end of shaft 102 and above the gear wheels 60 and an idler roller 105 cooperates with a groove 104 in the cam 103. The roller 105 is carried on one end of a horizontal lever 106 keyed on to the lower end of a vertical shaft 107.

The shaft 107 extends adjacent to the vertical shaft 40 and is arranged so that the upper end portion thereof extends through the cylindrical element 24 with its upper end protruding above the cylindrical element 24 and terminating within the casing 29. On the upper end of the shaft 107 is keyed a cranked arm 108 housed within the casing 29 and lying in a substantially horizontal plane.

A slot 109 is provided in the free end of the arm 108 which receives a vertically extending pin 110 for connecting the free end to one end of a horizontally extending connecting rod 111, the other end of which rod is connected, by means of a vertically extending pin 112, to one arm of a block member 113. A rod 114 extends horizontally through a bore of the block member 113 and is locked in the bore. The rod 114 is radially disposed relative to the axis of the wheel 15 and is aligned with the dispensing channel 46. The right end of the rod 114 as viewed in FIG. 1 protrudes outside the casing 29.

Due to the stepping motion hereinabove described, during rotation of cam 103 the rod 114 slides axially in two directions and moves through two slots 115 (only one is shown in the drawings) provided in the upper end of the hollow shaft 40. The rod 114 is supported, near its left end, by a slide block 116 secured inside the casing 29.

An idler roller 117 acts as a guide member for the rod 114 during the sliding movement thereof. The roller 117 has a horizontal axis and is supported by the block member 113 as it slides along a guide 118 provided on the inside of the casing 29.

At the right end of the rod 114 which protrudes outside the casing 29 the rod carries a substantially parallelepiped block member 119, hereinafter called a pushing member, the purpose of which is to eject, one by one, the cigarette packets 20 out of the compartments 17 of the wheel 15 and to introduce the individual packets 20 into the channel 46.

The gear wheel 61 rotates in a clockwise direction and is carried on the lower end of a vertical shaft 120, on which shaft a drum cam 121 is keyed.

An idler roller 123 cooperates with a cam groove 122 in the surface of the drum. The roller 123 is carried by one arm of a two-armed lever 124 pivotally mounted on a horizontal pivot pin 125, which pin is rotatably supported in a manner not shown in FIG. 1, by the wall 2 of the housing 1.

On the free end of the second arm of said two armed lever 124 there is pivotally connected the lower end of a vertical shaft 126 freely slidable within a guide 127 secured to the wall 6 and carrying on its upper end, externally of the housing 1, a substantially parallelepiped shaped block member 128, hereinafter called the elevator member, which is positioned beneath the crown member 16 and aligned with the aforementioned inlet position 32.

The gear wheel 62 rotates in a counterclockwise direction and is keyed to the lower end of a vertically extending shaft 129 which is rotatable by means of a pair of bevel gears 130 and 131 and a horizontally mounted shaft 132.

The shaft 132 is normally disposed relative to the wall 5 and protrudes from the housing 1 through the aforementioned tubular sleeve 11 in which it is supported by means of ball bearings 133. The other end of shaft 132, to which end a spur gear 134 is keyed, extends into the second housing 8.

The gear 134 is rotatable, by means of an idler gear 135 carried by a shaft 136 extending parallel to the shaft 132, and a further gear 137 carried by a shaft 138, parallel to the shaft 136, is integral with an co-axial to a cam 139. An idler roller 140, carried on the end of one arm of a two-armed lever 141, engages the cam profile of the cam 139, the lever 141 being pivoted about an axis 142 extending parallel to the shaft 138. The other arm of the lever 141 extends upwardly inside the second housing 8 and its upper end is provided with a slot 143.

The upper end portion of said other arm extends through a vertical slit 144 in a horizontally extending shaft 145 mounted parallel to the walls 9 and 10 of the second housing 8.

The shaft 145 is at the same level as the dispensing channel 46, is positioned normally to and adjacent the end thereof and is supported by the second housing 8 so as to be free to slide along its own axis.

A pin 146, parallel to the pivotal axis 142, of the lever 141 extends through the slot 144 and provides a connection between the lever 141 and shaft 145. At the right end of shaft 145 there is secured a rectangular plate member 147 disposed in a plane parallel relative to the longitudinal axis of the channel 46 and in line with the end extremities of walls 47 and 48. The rectangular plate member 147, in consideration of its operation, will hereinafter be called a "switching member".

A compression spring 148, coaxially disposed relative to the shaft 145, extends between and is connected to the left end of the shaft 145 and the rear wall (as seen in FIG. 1) of the second housing 8. Due to action of spring 148 and through the mechanical connections described above, the idler roller 140 is kept in close contact with the profile of the cam 139.

Adjacent to the left end of the shaft 145 a notch is provided in the underside thereof the purpose of which is to provide a detent, as will be described hereinafter, for the upper end of a vertical rod 150 formed integrally with the keeper of an ejection type electromagnet 151 supported by and externally of the second housing 8.

Due to the mechanical connections hereinbefore described, during rotation of the cam 139 the switching member 147 undergoes reciprocating movements transversely directed relative to the channel 46.

Let it now be supposed that the apparatus according to the present invention is operating under normal conditions. In these conditions, for reasons which will become apparent hereinafter, the electromagnets 93 and 151 are both de-energised and the rods 92 and 150 are in the retracted position shown in the figures.

Figure 4:
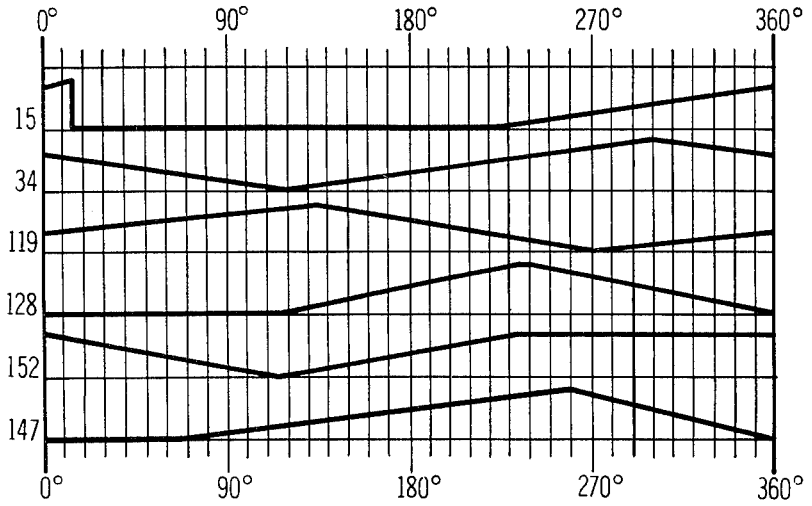
FIG. 4 shows, in the form of graphs plotted relative to a common reference, the relative motion of the important parts of the apparatus during one operating cycle.

The graphs of FIG. 4, to which reference will be made as the description proceeds, shown in a diagrammatic form angular movements of a common drive shaft (for example, shaft 102) which movements control the action of the more important members of the disclosed apparatus when in operation. In the graphs, the horizontal extends of the graph lines represent the dwell times, the ascending extents represent the forward or working motions and the descending extents represent the return or non-working motion of the members.

The circular crown member 16 with its thirty-seven compartments 17, due to the mechanical arrangement hereinabove described and including the Geneva wheel 67, the gear 72 and the crown gear 23, are intermittently rotated in a clockwise direction in 10° steps, i.e. that angle formed between two contiguous compartments 17.

The circular crown member 16 is arranged, relative to its supporting means, in such a manner that at each dwell of the stepping motion one compartment 17 is in register with the inlet position 32 and ready to receive a cigarette packet 20. The transfer of individual cigarette packets 20 into the compartments 17 is carried out by the elevator member 128 to which the cam 121 imparts, through the described mechanical arrangement, a reciprocating motion in a vertical plane. Simultaneously, the elevator member 128 operates an opposing member 152 secured to the lower end of a vertical shaft 153 and aligned with the shaft 126.

The opposing member 152 is reciprocatingly moved in a vertical plane by conventional means not shown in the Figures. During each dwell of the wheel 15 a cigarette packet 20, fed in a conventional manner by a second wheel 154 also provided with radial compartments for holding cigarette packets and shown in chain-dotted lines in the figures, is clamped between the elevator member 128 and the opposing member 152, at their respective end-of-stroke positions.

At the end of the upwardly directed stroke of said conventional reciprocating means, the packet 20 is inserted, longitudinally relative to the radius of the wheel 15 and edgewise relative to the plane of the same wheel, into that one of the compartments 17 which is dwelling in register with the inlet position 32.

The guiding wall 33 serves to ensure that the packet 20 is correctly inserted into each compartment 17. During the return stroke of the opposing member 152 it first moves upwardly a certain distance away from the cigarette packet 20 and the wheel 15 and then makes a 10° clockwise rotation so moving the cigarette packet between the two plates 34 and 35. Due to the stepping movement of the wheel 15 an empty compartment 17 reaches the inlet position 32 each time the elevator 128 and opposing member 152 make their forward stroke for transferring a new packet 20 from the wheel 154 into the empty compartment 17.

During the intermittent rotation of the wheel 15 the cigarette packets 20 are transferred from said inlet position 32 towards the outlet position 49, positioned at 270° from the inlet position, and are subjected to a drying action combined with a gauging action. These actions are carried out by the combined operation of the heated plates 34 and 35 acting against the sides of the packets, i.e. on the lateral faces thereof on which the final folding operations have been carried out, as stated in the preamble to the present specification.

During each dwell of the wheel 15 (see also the graphs of FIG. 4), the hollow shaft 40, due to rotation of the eccentric bearing 64 and motion of the lever 74 and the rocking lever 79, is moved axially downwardly, thus taking the heated plate 34 into close contact with the upper sides of the packets.

In these conditions of normal operation, the lower plate 35 remains connected to the circular crown member 16.

The arrangement is such that a consistent rhythmical compression of the packets 20 by the plate 34 is obtained. Moreover, the compression force is adjustable through the aforementioned adjusting means connecting the spider 39 to the shaft 40, and combined with the counteracting action of the stationary plate 35 and of the side walls 18 of compartments 17, provides for an exact gauging of the cigarette packets. The cigarette packets are, in this operation, enclosed within a parallelepiped mold which is complementary to their ideal dimensions and remains within this mold for a time lasting long enough to assure the drying of the glued portions by action of the heated plates 34 and 35.

When the individual packets reach the outlet position 49, each packet 20 is engaged on that end face thereof facing the rotational axis of the circular crown member 16 by the pushing member 119 and ejected from the associated compartment 17. The stroke of the pushing member 119, carried by the rod 114 and moved by the cam 103 through the lever 106, shaft 107, arm 108, connecting rod 11 and block member 113, is such as to cause a complete insertion of the particular packet 20 into the channel 46 and, therefore, the shifting of the row of packets along the channel 46 for a distance substantially corresponding to the longitudinal dimension of a packet.

In an embodiment not shown, in order to avoid an excessive constriction of the cigarette packets 20 along the dispensing channel 46, the latter may comprise the previously mentioned vertically disposed walls 47 and 48 as well as a pair of superimposed conveyor belts spaced apart a distance substantially corresponding to the width of the cigarette packets, the belts forming respectively, movable bottom and upper sides of said channel 46. The belts are conventionally moved with an intermittent motion synchronized with the reciprocating motion of the pushing member 119 and in the direction of the active or pushing stroke of the latter member.

Due to this forward movement of the row of packets, the first packet 20 on the right end of the row, as seen in FIG. 1, is pushed into that portion of the channel 46 not delimited by the vertical walls 47 and 48 and which is just in front of the switching member 147.

During the return stroke of the pushing member 119, in order to allow the wheel 15 to carry out a further advancement step, the pushing member 147 engages that side of the now stationary first packet 20 which is facing the pushing member, and pushes it transversely of the channel 46 onto the belt 52 which feeds the packet to other working stations of the packeting machine.

Figure 5:
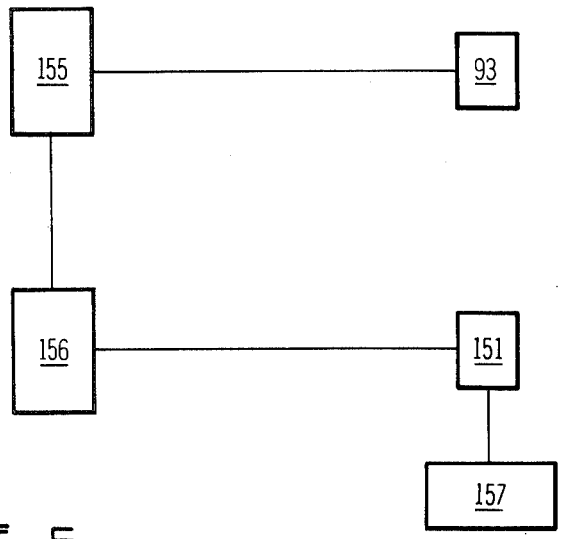
FIG. 5 shows, in the form of a block diagram, the control and driving means of the apparatus.

Let it now be supposed that the apparatus is operating under emergency conditions, i.e. conditions which arise when the wheel 15 stops. In this case the control means diagrammatically shown in FIG. 5 come into operation. The blocks shown in FIG. 5 represent the main motor 155 of the packeting machine, the electromagnet 93, a timer 156, a counter 157 and the electromagnet 151.

Should the motor 155 stop and consequently the wheel 15 stops also, in order to avoid the electrically heated plates 34 and 35 causing damage to the packets 20, the two plates 34 and 35 are moved away from the crown member 16 by excitation of the electromagnet 93.

Figure 2:
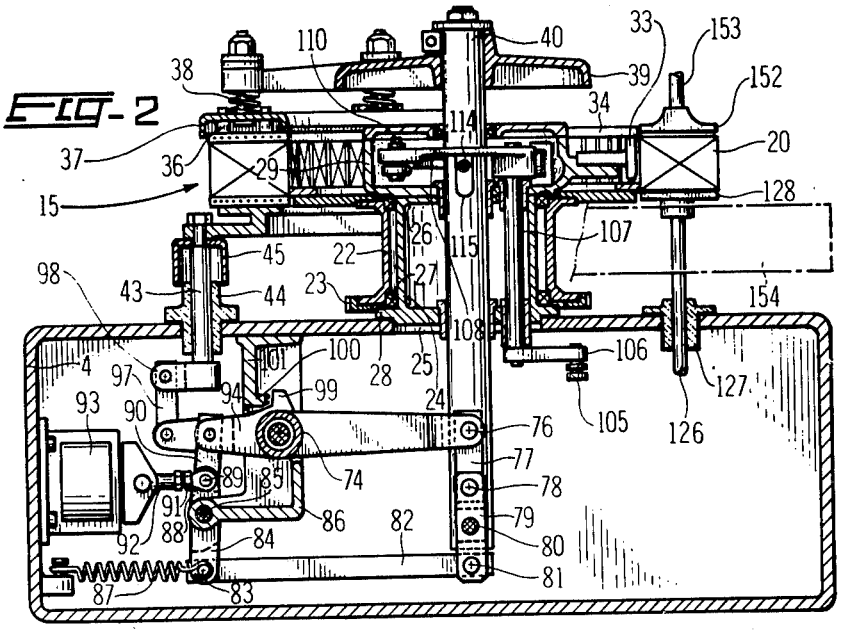
FIGS. 2 and 3 are frontal views, partly sectioned and with parts omitted for the sake of clarity showing the apparatus of FIG. 1 in two different operating conditions.
Figure 3:
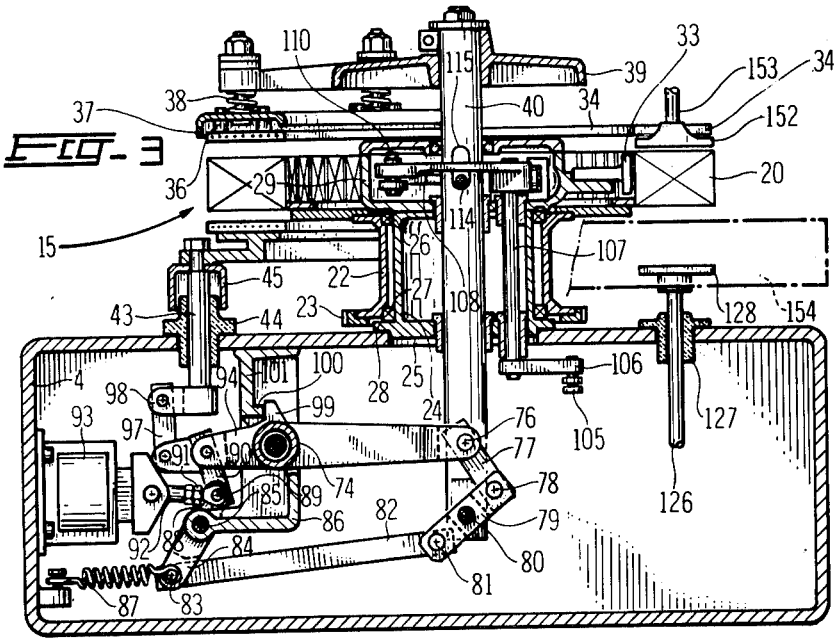

As soon as the electromagnet 93 is energised, its keeper is moved from left to right and the normal operating positions of the mechanical parts of the dispenser as depicted in FIG. 2 assume the dispositions shown in FIG. 3.

Due to the pressing action of the rod 92, through the articulated joint 91, against the pin 89, combined with the pulling action of the spring 87, the whole linkage formed by the lever 84, shaft 85 and lever 88 is subjected to a clockwise rotation. Due to such rotation, the pin 89 is deviated from the position shown in FIG. 2 and causes, through the link rod 90 and arm 94, a counterclockwise rotation of the tubular sleeve 95 and of the shaft 75 until the abutment provided by the tooth 99 strikes against the stop member 100. Through the levers 96 secured to the ends of the shaft 75, the link rods 97 and the levers 98, there is a corresponding axial shifting from an upper to a lower position of the two vertical shafts 43 and, therefore, the disjunction of plate 35 from the circular crown member 16. During this stage the cigarette packets are held in position inside the relative compartments 17 simply by compression.

The same clockwise rotation of lever 84 causes, through the rod 82 and pin 81, clockwise rotation of the rocking lever 79 about the pin 80 and a counterclockwise rotation, relative to the axis formed by the pin 76, of the link rod 77.

It will be appreciated that when the main motor 155 is stopped the two-armed lever 74 and therefore the pin 76 are stationary, and from FIGS. 2 and 3, it will be apparent that if there is a pull on the rod 82 there is, through the pin 80 which is connected to the lower end of the shaft 40, a corresponding upwardly directed axial sliding of the shaft 40 and, therefore, a displacement of the heating plate 34 away from the crown member 16 takes place.

The amount of upward movement of the plate 34 is calculated according to the temperature of the plate 34 and is, in any case, greater than the upward cyclic movement performed during normal operating conditions.

In the situation where the motor 155 does not remain stopped for a time, measured by the timer 156, which is longer than a preselected time chosen according to the operating temperature of the plates 34 and 35, the spacing of the plate 35 from the crown member 16 is sufficient to avoid damage to the cigarette packets and to their contents.

When the motor 155 restarts, the abnormal positions of the mechanical parts of the dispenser shown in FIG. 3 again assume, due to the automatic de-energisation of the electromagnet 93, the disposition shown in FIG. 2, i.e. the disposition appropriate to the normal operating conditions.

In the case described above, the electromagnet 152 remains de-energised.

Let it now be supposed that the wheel 15 stops for a time longer than the preselected one. In this case, notwithstanding the safety measures described above, the packets resting inside the compartments 17 are irremediably damaged by the heat radiated by plates 34 and 35 and therefore they have to be discarded.

When the stopping time exceeds the preselected time, the timer 156 allows the de-energisation of the electromagnet 151, which causes an upwardly directed sliding of the rod 150, the upper end of which engages the notch 149, thus locking the pushing member 147 in its retracted position aligned with the wall 47 of the dispensing channel 46. It is clear that in these conditions the idler roller 140 on the two-armed lever 141 remains disengaged from the cam 139 which continues to rotate about the axis 138. The cigarette packets 20 are, therefore, no longer engaged by the pushing member 147 and are directed by the same pushing member 119 which now forms an extension of the wall 47 in a continuous row along the rejecting track 51.

The electromagnet 151 remains de-energised, due to operation of the timer 157, for the number of machine cycles necessary to discard all the cigarette packets which were held inside the compartments 17 at the time of stopping of the main motor 155.

In the embodiment shown in the figures and as hereinabove described, the timer 157 will, after restarting of the normal operating condition of the main motor 155, maintain the electromagnet 151 in a de-energised state for thirty motor cycles, i.e. the number of cycles required to discard along the track 51 the twenty-seven cigarette packets contained in the compartments 17 of the wheel 15 plus three cigarette packets contained in the dispensing channel 46.

As soon as the electromagnet 151 is energised, again by intervention of the timer 157, the rod 150 returns to its lower position thus becoming disengaged from the notch 149 and allowing the pushing member 147 to restart its feeding of the cigarette packets 20 to the belt 52.

I claim:

1. In a dispensing apparatus for machines for packeting cigarettes into hinged-lid rigid type cigarette packets comprising a wheel carried by a shaft mounted perpendicularly to a base housing and provided with radially disposed compartments each for housing one cigarette packet longitudinally disposed relative to the radius of said wheel and edgewise relative to the plane of the wheel, a dispensing channel co-planar and radially disposed relative to said wheel, first driving means connected to main motor means of said machine for intermittently rotating said wheel, packet feeding means positioned upstream relative to the rotational direction of said wheel for feeding individual packets into said compartments, pushing means for ejecting the packets from said compartments and for feeding the same into and along said dispensing channel, an upper and lower heated plate delimiting the upper and the lower sides of said compartments, second driving means for reciprocatingly driving supporting means of said upper plate and for subjecting said plate, during each dwell of said wheel, to a displacing movement from a first position relatively spaced from said compartments to a second position in contact with the compartments, and stationary supporting means for said lower plate, the improvement which comprises:

a first and a second track at the end of said dispensing channel;

switching means mounted adjacent the end of the said dispensing channel for conveying individual packets onto said first track during a normal operating condition of the apparatus;

third driving means associated with said main motor means for driving said switching means;

first control means sensitive to the stopping of said main motor means;

timer means associated with said first control means for measuring the stopping time of said main motor means during an abnormal operating condition of the apparatus;

fourth driving means controlled by said first control means for driving said supporting means of the lower and upper plates for moving said plates to a position relatively spaced from the compartments during a first stage of said abnormal operating condition;

second control means controlled by said timer means when the latter measures a duration of the stopping time during a second stage of said abnormal operating condition which is longer than a preselected time;

locking means controlled by said second control means for locking said switching means for conveying individual packets into said second track; and counting means associated with said main motor means and with said locking means for disengaging said locking means following restoration of said normal operating condition of the apparatus after counting a number of machine cycles equal to the number of packets contained in said dispensing apparatus.

2. A dispensing apparatus according to claim 1, wherein said first control means comprises electromagnetic means and said fourth driving means comprises two associated mechanical systems both connected to said first control means, the first system for displacing the lower plate and the second system for displacing the upper plate.

3. A dispensing apparatus according to claim 2, wherein said second mechanical system comprises lever means for imparting a movement to the supporting means of the upper plate for displacing said upper plate from said compartments which movement is greater than the movement imparted to the same supporting means by said second driving means.

4. A dispensing apparatus according to claim 3, wherein said supporting means comprises a main shaft substantially coaxial relative to said wheel and connected to said wheel through upstanding registration means.

5. A dispensing apparatus according to claim 1, wherein said dispensing channel has a length equal to or a multiple of the longitudinal dimension of a packet and said first track is coplanar and normal to said dispensing channel and said second track is coplanar to and aligned with said dispensing channel.

6. A dispensing apparatus according to claim 1, wherein said switching means comprises a pushing member transversely disposed relative to said dispensing channel adjacent to the end portion thereof, said third driving means acting on said pushing member to shift it from a first position in which it is retracted relative to said dispensing channel to a second forward position for feeding said packets onto said first track, and returning it to said first position.

7. A dispensing apparatus according to claim 6, wherein said second control means comprises electromagnetic means and the locking means acts on said pushing member to lock it in said first retracted position.

* * * * *